US012534843B2

(12) United States Patent
Fuchs et al.

(10) Patent No.: US 12,534,843 B2
(45) Date of Patent: Jan. 27, 2026

(54) SYSTEMS AND METHODS FOR DETECTING OBJECTS WITHIN A LAUNDRY APPLIANCE

(71) Applicant: Haier US Appliance Solutions, Inc., Wilmington, DE (US)

(72) Inventors: Jason Fuchs, Louisville, KY (US); Carrie Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 57 days.

(21) Appl. No.: 18/601,460

(22) Filed: Mar. 11, 2024

(65) Prior Publication Data

US 2025/0283264 A1 Sep. 11, 2025

(51) Int. Cl.

| | |
|---|---|
| ***D06F 34/18*** | (2020.01) |
| ***D06F 34/05*** | (2020.01) |
| *D06F 103/02* | (2020.01) |
| *D06F 105/58* | (2020.01) |

(52) U.S. Cl.
CPC ..... *D06F 34/18* (2020.02); *D06F 34/05* (2020.02); *D06F 2103/02* (2020.02); *D06F 2105/58* (2020.02)

(58) Field of Classification Search
CPC ..... D06F 34/18; D06F 34/05; D06F 2103/02; D06F 2105/58
See application file for complete search history.

(56) References Cited

U.S. PATENT DOCUMENTS

| | | | |
|---|---|---|---|
| 7,680,691 B2 | 3/2010 | Kimball et al. | |
| 8,482,425 B2 | 7/2013 | Lauer et al. | |
| 2008/0283585 A1 | 11/2008 | Peterman et al. | |
| 2009/0146811 A1 | 6/2009 | Burka et al. | |
| 2017/0241066 A1 | 8/2017 | Caspers | |
| 2021/0182939 A1* | 6/2021 | Bajovic | G06Q 30/0631 |
| 2023/0124027 A1* | 4/2023 | Mashal | H04L 67/12 348/143 |
| 2023/0295861 A1* | 9/2023 | Hibdon | D06F 39/087 68/12.05 |

FOREIGN PATENT DOCUMENTS

| | | |
|---|---|---|
| EP | 2527517 B1 | 4/2016 |
| JP | 2006129916 A | 5/2006 |

OTHER PUBLICATIONS

Atlas RFID, Laundry Tracking Sample Pack, accessed https://www.atlasrfidstore.com/laundry-tracking-sample-pack/, on Mar. 11, 2024, 15 pages.

* cited by examiner

*Primary Examiner* — An T Nguyen
(74) *Attorney, Agent, or Firm* — Dority & Manning, P.A.

(57) ABSTRACT

A method of operating a laundry appliance may include initiating a laundry cycle of the laundry appliance. The method may also include evaluating, with a sensor assembly, a classification of an object within an interior of the laundry appliance. The method may further include commencing a locked down operational state in response to evaluating the classification of the object within the interior of the laundry appliance. The method may also include providing a push notification on a remote user interface device based on commencing the locked down operational state. The push notification may include information indicative of the object.

16 Claims, 7 Drawing Sheets

SYSTEMS AND METHODS FOR DETECTING OBJECTS WITHIN A LAUNDRY APPLIANCE

FIELD OF THE DISCLOSURE

The present subject matter relates generally to a laundry appliance, and more particularly, detecting objects within a laundry appliance.

BACKGROUND OF THE DISCLOSURE

Laundry appliances generally include washing machine appliances and dryer appliances. Washing machine appliances generally include a tub for containing water or wash fluid, e.g., water and detergent, bleach, or other wash additives. A basket is rotatably mounted within the tub and defines a wash chamber for receipt of articles for washing. Dryer appliances generally include a drum and a heater or heater assembly provided to pass heated air through the chamber of the drum in order to dry moisture-laden articles disposed within the chamber.

Often, a user of the laundry appliance may accidentally place items into the tub or the drum of the laundry appliance. Further improvements are necessary to notify a user of the laundry appliance that the items have been accidentally placed within the laundry appliance. For instance, if a laundry cycle of the laundry appliance is run with the item positioned within the tub or the drum, damage to articles (e.g., clothes, towels, sheets, etc.) or to the items accidentally placed accidently placed within the laundry appliance may occur. For example, a user may accidentally place electronic items, such as cell phones, tablets, car keys, etc., into the tub or the drum of the laundry appliance. If a laundry cycle is run with the electronic items placed within the laundry appliance, damage to the electronic item may occur. As another example, a user may accidentally place non-electronic items, such as pens, lipstick, markers, etc., into the tub or the drum of the laundry appliance. If a laundry cycle is run with the non-electronic items placed within the laundry appliance, damage to the articles held within the laundry appliance may occur.

Accordingly, systems and methods for obviating one or more of the above-mentioned drawbacks would be useful.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a method of operating a laundry appliance is provided. The method may include initiating a laundry cycle of the laundry appliance. The method may include evaluating, with a sensor assembly, a classification of an object within an interior of the laundry appliance. The method may include commencing a locked down operational state in response to evaluating the classification of the object within the interior of the laundry appliance. The method may include providing a push notification on a remote user interface device based on commencing the locked down operational state. The push notification may include information indicative of the object.

In another exemplary aspect of the present disclosure, a laundry appliance is provided. The laundry appliance may include a cabinet defining an interior for receiving articles for laundering. The laundry appliance may include a sensor assembly attached to the cabinet. The laundry appliance may include a controller configured for: initiating a laundry cycle of the laundry appliance; evaluating, with the sensor assembly, a classification of an object within an interior of the laundry appliance; commencing a locked down operational state in response to evaluating the classification of the object within the interior of the laundry appliance; and providing a push notification on a remote user interface device based on commencing the locked down operational state, the push notification including information indicative of the object.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
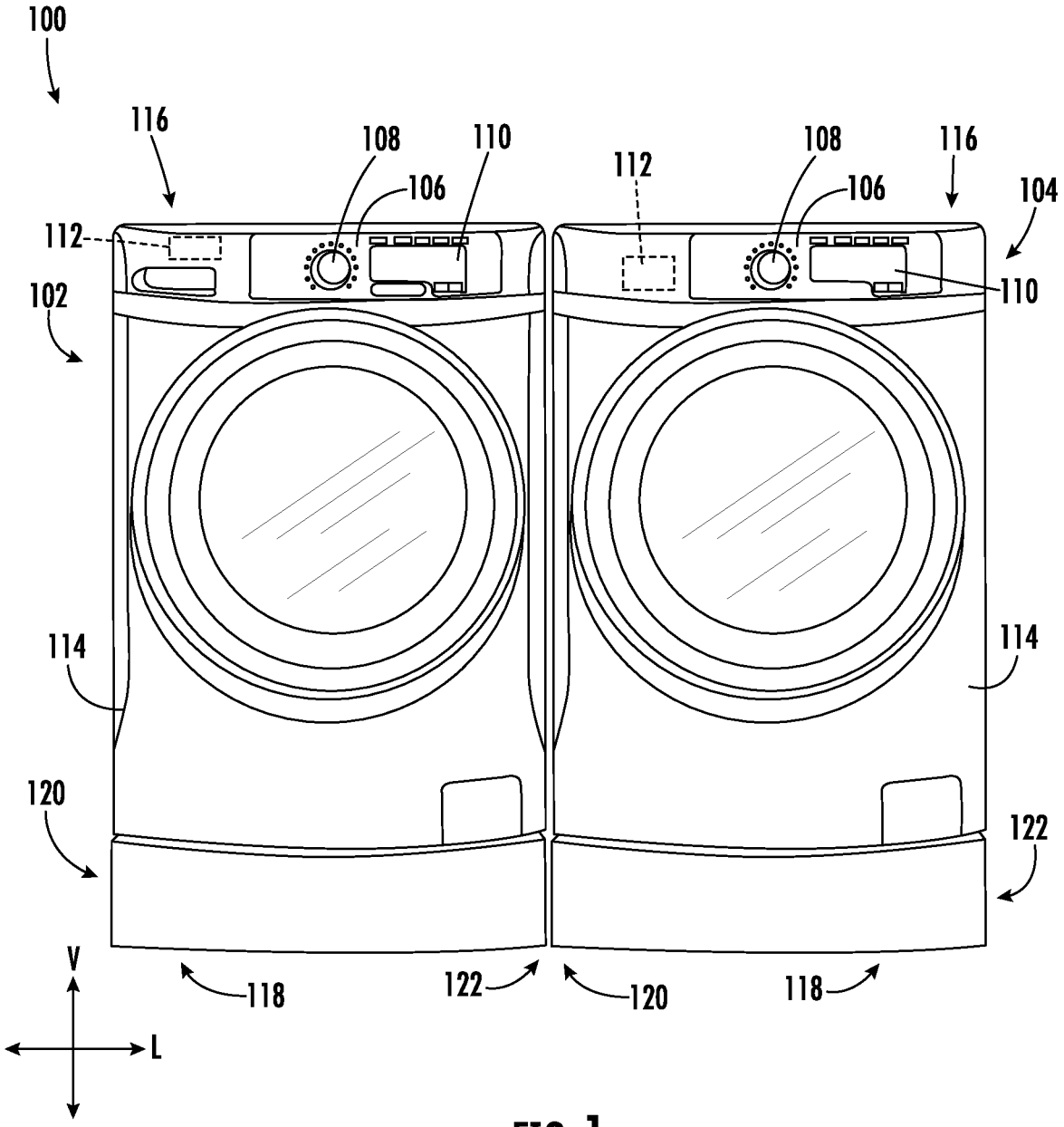
FIG. 1 provides a front view of exemplary household appliances, e.g., an exemplary washing machine appliance and an exemplary dryer appliance, in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Directional terms such as "left" and "right" are used herein with reference to the perspective of a user standing in front of a household appliance to access the appliance or items therein. Terms such as "inner" and "outer" refer to relative directions with respect to the interior and exterior of the appliance. For example, "inner" or "inward" refers to the direction towards the interior of the appliance. Terms such as "left," "right," "front," "back," "top," or "bottom" are used with reference to the perspective of a user accessing the appliance. For example, a user stands in front of the appliance to open the door(s) and reaches into the appliance to add, move, or withdraw items therein.

As used herein, the terms "first," "second," and "third" may be used interchangeably to distinguish one component from another and are not intended to signify location or importance of the individual components. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Embodiments of the present subject matter advantageously provide systems and methods for detecting unwanted items in laundry appliances. For example, embodiments of the present subject matter advantageously utilize short-range wireless singes (e.g., RFID or any suitable short-range wireless signal) embedded on or within the item to detect the presence of the item within the laundry appliance. In some embodiments, the systems and methods of the present subject matter may advantageously detect the presence of an unwanted item before the appliance starts.

Figure 2:
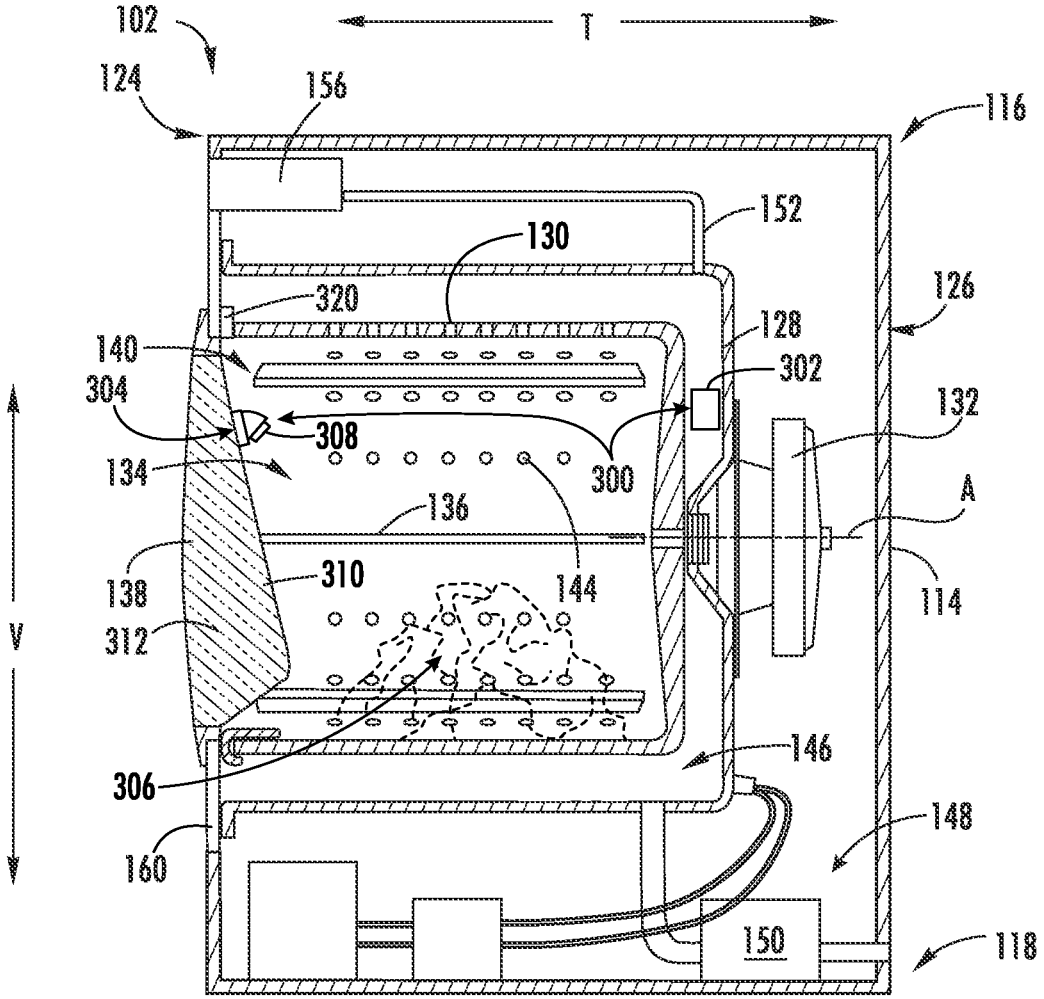
FIG. 2 provides a transverse cross-sectional view of the exemplary washing machine appliance of FIG. 1.
Figure 3:
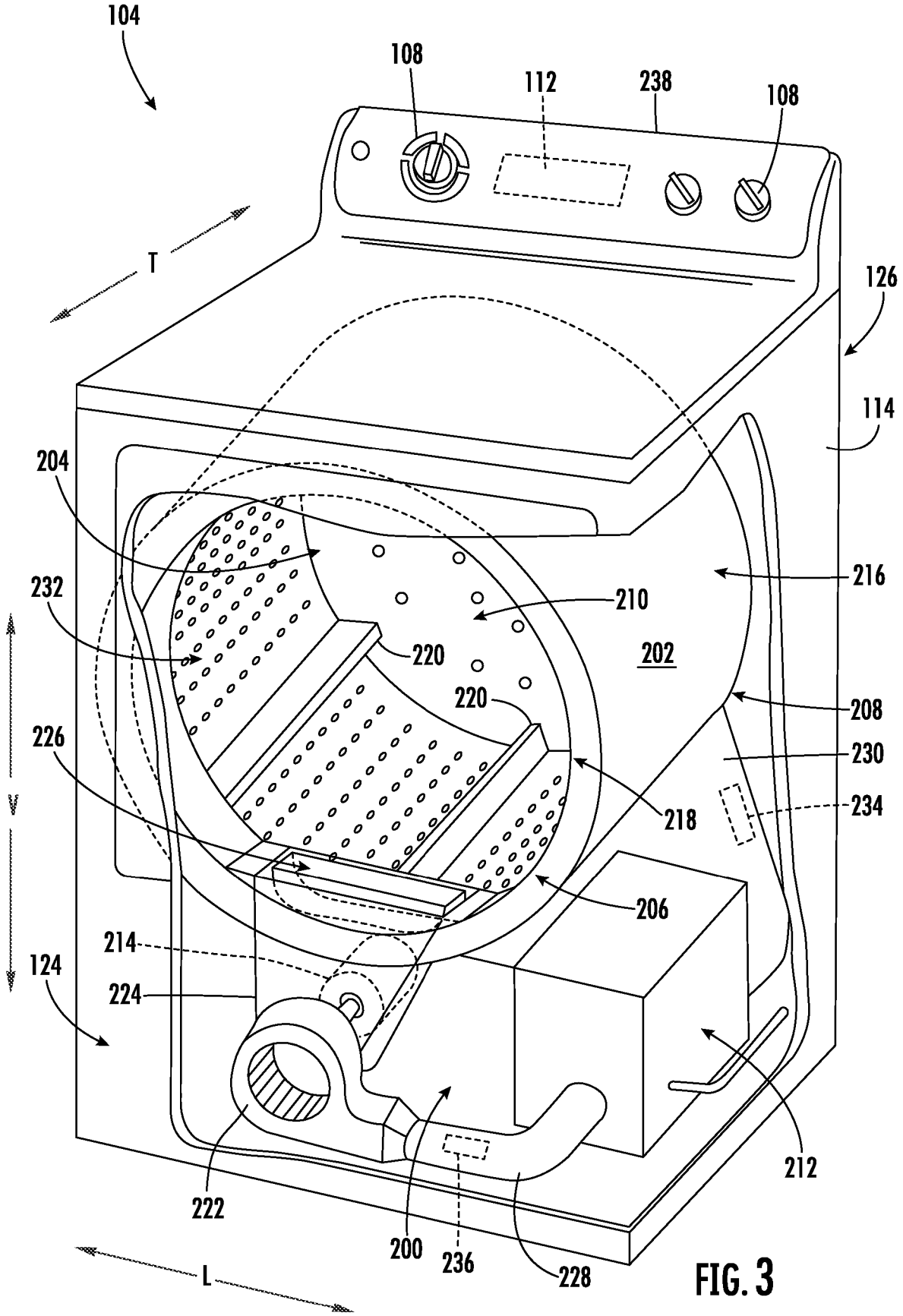
FIG. 3 provides a perspective view of the exemplary dryer appliance of FIG. 1 with portions of a cabinet of the dryer appliance removed to reveal certain components of the dryer appliance.

Referring now to the figures, exemplary laundry appliances 100 are illustrated in FIGS. 1 through 3. In various embodiments of the present subject matter, a laundry appliance may be any suitable laundry appliance, such as a washing machine appliance 102, a dryer appliance 104, a combination washer-dryer appliance, etc. The dryer appliance 104 is separately labelled in FIG. 1 to distinguish the dryer appliance 104 from the washing machine appliance 102, where both the washing machine appliance 102 and the dryer appliance 104 are example embodiments of a laundry appliance 100 which may be usable in one or more exemplary methods described herein or may be operable and configured to perform such methods.

As may be seen generally throughout figures, user interface panels 106 and a user input device 108 may be positioned on an exterior of the laundry appliances 100. The user input device 108 is generally positioned proximate to the user interface panel 106, and in some embodiments, the user input device 108 may be positioned on the user interface panel 106.

In various embodiments, the user interface panel 106 may represent a general purpose I/O ("GPIO") device or functional block. In some embodiments, the user interface panel 106 may include or be in operative communication with user input device 108, such as one or more of a variety of digital, analog, electrical, mechanical or electro-mechanical input devices including rotary dials, control knobs, push buttons, and touch pads. The user interface panel 106 may include a display component 110, such as a digital or analog display device designed to provide operational feedback to a user. The display component 110 may also be a touchscreen capable of receiving a user input, such that the display component 110 may also be a user input device in addition to or instead of the user input device 108.

User interface panel 106, including user input device 108 and display component 110 thereon, provides a local user interface, e.g., a means for users to communicate with and operate the laundry appliance 100. Thus, user interface panel 106 and the local user interface provide a means for users to communicate with and operate laundry appliance 100. It will be appreciated that other components or devices that provide for communication with laundry appliance 100 for operating laundry appliance 100 may also be included in the user interface. For example, the user interface may include a speaker, a microphone, a camera (still or video) or motion detection camera for detecting a user's proximity to laundry appliance 100 or for picking up certain motions, or other user interface elements in various combinations.

Generally, each laundry appliance 100 may include a controller 112 in operative communication with the user input device 108. As used herein, "processing device" or "controller" may refer to one or more microprocessors, microcontroller, ASICS, or semiconductor devices and is not restricted necessarily to a single element. The controller 112 may be programmed to operate laundry appliance 100 by executing instructions stored in memory (e.g., non-transitory media). The user interface panel 106 and the user input device 108 may be in communication with the controller 112 via, for example, one or more signal lines or shared communication busses. Input/output ("I/O") signals may be routed between controller 112 and various operational components of the appliance. Operation of the appliance can be regulated by the controller 112 that is operatively coupled to the user interface panel 106. A user interface panel 106 may for example provide selections for user manipulation of the operation of an appliance, e.g., via user input device 108 or display component 110. In response to user manipulation of the user interface panel 106 or user input device 108, the controller 112 may operate various components of the appliance. Controller 112 may include a memory and one or more microprocessors, CPUs or the like, such as general or special purpose microprocessors operable to execute programming instructions or micro-control code associated with operation of the appliance. The memory may represent one or more memory elements, e.g., random access memory such as DRAM, or read only memory such as ROM or FLASH, or electrically erasable, programmable read only memory (EEPROM). In one embodiment, the processor executes programming instructions stored in memory. The memory may be a separate component from the processor or may be included onboard within the processor. Alternatively, a controller 112 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

The controller 112 may be programmed to operate the laundry appliances 100 by executing instructions stored in memory. For example, the instructions may be software or any set of instructions that when executed by the processing device, cause the processing device to perform operations. Controller 112 can include one or more processor(s) and associated memory device(s) configured to perform a variety of computer-implemented functions or instructions (e.g. performing the methods, steps, calculations and the like and storing relevant data as disclosed herein). Controller 112 may include a network interface such that controller 112 can connect to and communicate over one or more networks with one or more network nodes. Controller 112 can also include one or more transmitting, receiving, or transceiving components for transmitting/receiving communications with other devices communicatively coupled with laundry appliance 100. Additionally or alternatively, one or more transmitting, receiving, or transceiving components can be located off board controller 112. It should be noted that controllers 112 as disclosed herein are capable of and may be operable to perform any methods and associated method steps as disclosed herein. For example, in some embodiments, methods disclosed herein may be embodied in programming instructions stored in the memory and executed by the controller 112.

As generally seen throughout FIGS. 1 through 3, in at least some embodiments, each of the laundry appliances 100 (e.g., the washing machine appliance 102 or the dryer appliance 104) include a cabinet 114 which defines a vertical direction V, a lateral direction L, and a transverse direction T that are mutually perpendicular. Each cabinet 114 extends between a top side 116 and a bottom side 118 along the vertical direction V. Each cabinet 114 also extends between a left side 120 and a right side 122, e.g., along the lateral direction L, and between a front side 124 and a rear side 126 along the transverse direction T.

Additional exemplary details of each laundry appliance are illustrated in FIGS. 2 and 3. For example, FIG. 2 provides a cross-sectional view of the exemplary washing machine appliance 102. As illustrated in FIG. 2, a wash tub 128 is non-rotatably mounted within cabinet 114. As may be seen in FIG. 2, the wash tub 128 defines a central axis A. In the example embodiment illustrated by FIG. 2, the central axis A may be oriented generally along or parallel to the transverse direction T of the washing machine appliance 102. Accordingly, the washing machine appliance 102 may be referred to as a horizontal axis washing machine.

Referring again to FIG. 2, a wash basket 130 is rotatably mounted within the wash tub 128 such that the wash basket 130 is rotatable about an axis of rotation, which generally coincides with central axis A of the wash tub 128. A motor 132, e.g., such as a pancake motor, is in mechanical communication with wash basket 130 to selectively rotate wash basket 130 (e.g., during an agitation or a rinse cycle of washing machine appliance 102). Wash basket 130 defines a wash chamber 134 that is configured for receipt of articles for washing. The wash tub 128 holds wash and rinse fluids for agitation in wash basket 130 within wash tub 128. As used herein, "wash fluid" may refer to water, detergent, fabric softener, bleach, or any other suitable wash additive or combination thereof. The wash basket 130 and the wash tub 128 may collectively define at least a portion of a tub assembly for the washing machine appliance 102.

Wash basket 130 may define one or more agitator features that extend into wash chamber 134 to assist in agitation and cleaning of articles disposed within wash chamber 134 during operation of washing machine appliance 102. For example, as illustrated in FIG. 2, a plurality of ribs 136 extends from wash basket 130 into wash chamber 134. In this manner, for example, ribs 136 may lift articles disposed in wash basket 130 during rotation of wash basket 130.

Referring generally to FIGS. 1 and 2, cabinet 114 also includes a front panel 160 which defines an opening 140 that permits user access to wash basket 130 within wash tub 128. More specifically, washing machine appliance 102 includes a door 138 that is positioned in front of opening 140 and is rotatably mounted to front panel 160. Door 138 is rotatable such that door 138 permits selective access to opening 140 by rotating between an open position (not shown) facilitating access to a wash tub 128 and a closed position (FIG. 1) prohibiting access to wash tub 128.

A window 142 in door 138 permits viewing of wash basket 130 when door 138 is in the closed position, e.g., during operation of washing machine appliance 102. Door 138 also includes a handle (not shown) that, e.g., a user may pull when opening and closing door 138. Further, although door 138 is illustrated as mounted to front panel 160, it should be appreciated that door 138 may be mounted to another side of cabinet 114 or any other suitable support according to alternative embodiments. The door 138 may further include a latching assembly or door lock that may be selectively actuated or engaged to lock door 138 in the closed position.

Referring again to FIG. 2, wash basket 130 also defines a plurality of perforations 144 in order to facilitate fluid communication between an interior of wash basket 130 and wash tub 128. A sump 146 is defined by wash tub 128 at a bottom of wash tub 128 along the vertical direction V. Thus, sump 146 is configured for receipt of and generally collects wash fluid during operation of washing machine appliance 102. For example, during operation of washing machine appliance 102, wash fluid may be urged by gravity from wash basket 130 to sump 146 through plurality of perforations 144.

A drain pump assembly 148 is located beneath wash tub 128 and is in fluid communication with sump 146 for periodically discharging soiled wash fluid from washing machine appliance 102. Drain pump assembly 148 may generally include a drain pump 150 which is in fluid communication with sump 146 and with an external drain (not shown). During a drain cycle, drain pump 150 urges a flow of wash fluid from sump 146 and to the external drain. More specifically, drain pump 150 includes a motor (not shown) which is energized during a drain cycle such that drain pump 150 draws wash fluid from sump 146 and urges it to the external drain.

A spout 152 is configured for directing a flow of fluid into wash tub 128. For example, spout 152 may be in fluid communication with a water supply (not shown) in order to direct fluid (e.g., clean water) into wash tub 128. Spout 152 may also be in fluid communication with the sump 146. For example, drain pump assembly 148 may direct wash fluid disposed in sump 146 to spout 152 in order to circulate wash fluid in wash tub 128.

As illustrated in FIG. 2, a detergent drawer 156 is slidably mounted within front panel 160. Detergent drawer 156 receives a wash additive (e.g., detergent, fabric softener, bleach, or any other suitable liquid or powder) and directs the fluid additive to wash chamber 134 during operation of washing machine appliance 102. According to the illustrated embodiment, detergent drawer 156 may also be fluidly coupled to spout 152 to facilitate the complete and accurate dispensing of wash additive.

During operation of washing machine appliance 102, e.g., during a wash cycle of the washing machine appliance 102, a laundry items are loaded into wash basket 130 through opening 140, and washing operation is initiated through operator manipulation of input selectors 108 (FIG. 1). Wash tub 128 is filled with water, detergent, or other fluid additives, e.g., via spout 152 or detergent drawer 156. One or more valves (not shown) can be controlled by washing machine appliance 102 to provide for filling wash basket 130 to the appropriate level for the amount of articles being washed or rinsed. By way of example for a wash mode, once wash basket 130 is properly filled with fluid, the contents of wash basket 130 can be agitated (e.g., with ribs 136) for washing of laundry items in wash basket 130.

After the agitation phase of the wash cycle is completed, wash tub 128 can be drained. Laundry articles can then be rinsed by again adding fluid to wash tub 128, depending on the particulars of the cleaning cycle selected by a user. Ribs 136 may again provide agitation within wash basket 130. One or more spin cycles may also be used. In particular, a spin cycle may be applied after the wash cycle or after the rinse cycle in order to wring wash fluid from the articles being washed. During a spin cycle, wash basket 130 is rotated at relatively high speeds. After articles disposed in wash basket 130 are cleaned or washed, the user can remove the articles from wash basket 130, e.g., by opening door 138 and reaching into wash basket 130 through opening 140.

While described in the context of a specific embodiment of horizontal axis washing machine appliance 102, using the teachings disclosed herein it will be understood that horizontal axis washing machine appliance 102 is provided by way of example only. It should be appreciated that the present subject matter is not limited to any particular style, model, or configuration of washing machine appliance. Other washing machine appliances having different configurations, different appearances, or different features may also be utilized with the present subject matter as well, e.g., vertical axis washing machine appliances.

FIG. 3 provides a perspective view of the dryer appliance 104 of FIG. 1, which is an example embodiment of a laundry appliance, and is an example embodiment of a laundry appliance 100, with a portion of a cabinet 114 of dryer appliance 104 removed in order to show certain components of dryer appliance 104. Dryer appliance 104 generally defines a vertical direction V, a lateral direction L, and a transverse direction T, each of which is mutually perpendicular, such that an orthogonal coordinate system is defined. While described in the context of a specific embodiment of dryer appliance 104, using the teachings disclosed herein, it will be understood that dryer appliance 104 is provided by way of example only. Other dryer appliances having different appearances and different features may also be utilized with the present subject matter as well.

Cabinet 114 includes a front side 124 and a rear side 126 spaced apart from each other along the transverse direction T. Within cabinet 114, an interior volume 200 is defined. A container or drum 202 is mounted for rotation about a substantially horizontal axis within the interior volume 200. Drum 202 defines a chamber 204 for receipt of articles of clothing for tumbling or drying. Drum 202 extends between a front portion 206 and a back portion 208. Drum 202 also includes a back or rear wall 210, e.g., at back portion 208 of drum 202. A supply duct 230 may be mounted to rear wall 210 and receives heated air that has been heated by a heating assembly 212.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing or articles that may be washed together in a washing machine or dried together in a dryer appliance 104 (e.g., clothes dryer) and may include a mixture of different or similar articles of clothing of different or similar types and kinds of fabrics, textiles, garments and linens within a particular laundering process.

A motor 214 is provided in some embodiments to rotate drum 202 about the horizontal axis, e.g., via a pulley and a belt (not pictured). Drum 202 is generally cylindrical in shape, having an outer cylindrical wall 216 and a front wall 218 that defines an opening 232 of drum 202, e.g., at front portion 206 of drum 202, for loading and unloading of articles into and out of chamber 204 of drum 202. A plurality of lifters or baffles 220 are provided within chamber 204 of drum 202 to lift articles therein and then allow such articles to tumble back to a bottom of drum 202 as drum 202 rotates. Baffles 220 may be mounted to drum 202 such that baffles 220 rotate with drum 202 during operation of dryer appliance 104.

The rear wall 210 of drum 202 may be rotatably supported within the cabinet 114 by a suitable fixed bearing. Rear wall 210 can be fixed or can be rotatable. Rear wall 210 may include, for instance, a plurality of holes that receive hot air that has been heated by heating assembly 212. The heating assembly 212 may include, e.g., a heat pump, an electric heating element, or a gas heating element (e.g., gas burner). Moisture laden, heated air is drawn from drum 202 by an air handler, such as blower fan 222, which generates a negative air pressure within drum 202. The moisture laden heated air passes through a duct 224 enclosing screen filter 226, which traps lint particles. As the air passes from blower fan 222, it enters a duct 228 and then is passed into heating assembly 212. In some embodiments, the dryer appliance 104 may be a conventional dryer appliance, e.g., the heating assembly 212 may be or include an electric heating element, e.g., a resistive heating element, or a gas-powered heating element, e.g., a gas burner. In other embodiments, the dryer appliance may be a condensation dryer, such as a heat pump dryer. In such embodiments, heating assembly 212 may be or include a heat pump including a sealed refrigerant circuit. Heated air (with a lower moisture content than was received from drum 202), exits heating assembly 212 and returns to drum 202 by duct 230. After the clothing articles have been dried, they are removed from the drum 202 via opening 232. A door (FIG. 1) provides for closing or accessing drum 202 through opening 232.

In some exemplary embodiments, the dryer appliance 104 may include one or more temperature sensors, such as inlet temperature sensor 234 or outlet temperature sensor 236. The temperature sensor(s) may be in operative communication with the controller 112. For example, in various embodiments, the controller 112 may be operable to detect, measure, or monitor one or more temperatures within the dryer appliance 104. Such temperatures which may be detected, measured, or monitored include, for example, an inlet temperature measured with the inlet temperature sensor 234 or an outlet temperature measured with the outlet temperature sensor 236. The inlet temperature sensor 234 and outlet temperature sensor 236 may be, in some embodiments, thermistors. As used herein, "temperature sensor" or the equivalent is intended to refer to any suitable type of temperature measuring system or device positioned at any suitable location for measuring the desired temperature. Thus, for example, inlet temperature sensor 234 or outlet temperature sensor 236 may each be any suitable type of temperature sensor, such as a thermistor, a thermocouple, a resistance temperature detector, a semiconductor-based integrated circuit temperature sensors, etc. In addition, inlet temperature sensor 234 or outlet temperature sensor 236 may be positioned at any suitable location and may output a signal, such as a voltage, to a controller that is proportional to, or indicative of the temperature being measured. Although exemplary positioning of temperature sensors is described herein, it should be appreciated that dryer appliance 104 may include any other suitable number, type, and position of temperature, humidity, or other sensors according to alternative embodiments.

In some embodiments, one or more selector inputs 108, such as knobs, buttons, touchscreen interfaces, etc., may be provided or mounted on the cabinet 114 (e.g., on a backsplash 238) and are in operable communication (e.g., electrically coupled or coupled through a wireless network band) with the processing device or controller 112. Controller 112 may also be provided in operable communication with components of the dryer appliance 104 including motor 214, blower 222, or heating assembly 212. In turn, signals generated in controller 112 direct operation of motor 214, blower 222, or heating assembly 212 in response to the position of inputs 108.

As will be described in more detail below, laundry appliance 100 may further include a sensor assembly 300 to detect objects within the interior of the laundry appliance 100. Particularly, the sensor assembly 300 may detect objects that may have been accidentally placed within the wash basket 130 of the washing machine appliance 102 or the drum 202 of the dryer appliance 104 to permit a user to remotely inspect the laundry appliance 100. The sensor assembly 300 may be attached to or positioned proximate to the wash basket 130 or the drum 202 of the laundry appliances 100.

In some embodiments, the sensor assembly 300 includes a short-range wireless receiver 302. The short-range wireless receiver 302 may be attached to the wash basket 130 or the drum 202 of the laundry appliances 100. The short-range wireless receiver 302 include one or more short-range wireless modules that are configured to receive short range signals that may be transmitted from one or more objects positioned within the wash basket 130 or the drum 202. For instance, the short-range wireless receiver 302 may be configured to receive short-range signals from an electronic device or an object including an embedded short-range transmitter. For example, the short-range wireless receiver 302 may include a Radio-Frequency Identification (RFID) module that is configured to receive RFID signals transmitted from an RFID embedded device. As another example, the short-range wireless receiver 302 may include a Bluetooth module that is configured to receive Bluetooth signals transmitted from a Bluetooth embedded device.

In some other embodiments, the sensor assembly includes a camera assembly 304 for obtaining images of contents within a cavity of the laundry appliance 100, e.g., a load of clothes (as identified schematically by reference numeral 306 in FIG. 2) within wash chamber 134 of washing machine appliance 102. The camera assembly 304 may include internal camera 308 generally positioned and configured for obtaining images of contents within the cavity of the laundry appliance. Specifically, according to the illustrated embodiment, door 138 of washing machine appliance 102 comprises an inner window 310 that partially defines wash chamber 134 and an outer window 312 that is exposed to the ambient environment. According to the illustrated exemplary embodiment, camera assembly 304 includes interior camera 308 that is mounted to inner window 310. Specifically, camera 308 is mounted such that is faces toward a bottom side of wash tub 128. In this manner, camera 308 can take images or video of an inside of wash chamber 134 and remains unobstructed by windows that may obscure or distort such images.

The camera assembly 304 may use any suitable image processing technique, image recognition process, etc., to sense objects with the unapproved classification within the interior of the laundry appliance. As used herein, the terms "image analysis" and the like may be used generally to refer to any suitable method of observation, analysis, image decomposition, feature extraction, image classification, etc. of one or more images, videos, or other visual representations of an object. As explained in more detail below, this image analysis may include the implementation of image processing techniques, image recognition techniques, or any suitable combination thereof. In this regard, the image analysis may use any suitable image analysis software or algorithm to constantly or periodically monitor the door 138. It should be appreciated that this image analysis or processing may be performed locally (e.g., by controller 112 or remotely) (e.g., by offloading image data to a remote server or network).

Specifically, the analysis of the one or more images may include implementation an image processing algorithm. As used herein, the terms "image processing" and the like are generally intended to refer to any suitable methods or algorithms for analyzing images that do not rely on artificial intelligence or machine learning techniques (e.g., in contrast to the machine learning image recognition processes described below). For example, the image processing algorithm may rely on image differentiation, e.g., such as a pixel-by-pixel comparison of two sequential images. This comparison may help identify substantial differences between the sequentially obtained images, e.g., to identify movement, the presence of a particular object, the existence of a certain condition, etc. For example, one or more reference images may be obtained when a particular condition exists, and these references images may be stored for future comparison with images obtained during appliance operation. Similarities and/or differences between the reference image and the obtained image may be used to extract useful information for improving appliance performance.

According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, greyscale matching, histograms of receptive field responses, or another suitable routine (e.g., executed at the controller 112 based on one or more captured images from one or more optical instruments such as the internal camera 308). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

In addition to the image processing techniques described above, the image analysis may include utilizing artificial intelligence ("AI"), such as a machine learning image recognition process, a neural network classification module, any other suitable artificial intelligence (AI) technique, and/or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained images.

In this regard, the image recognition process may use any suitable artificial intelligence technique, for example, any suitable machine learning technique, or for example, any suitable deep learning technique. According to an exemplary embodiment, the image recognition process may include the implementation of a form of image recognition called region based convolutional neural network ("R-CNN") image recognition. Generally speaking, R-CNN may include taking an input image and extracting region proposals that include a potential object or region of an image. In this regard, a "region proposal" may be one or more regions in an image that could belong to a particular object or may include adjacent regions that share common pixel characteristics. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like, as opposed to a regular R-CNN architecture. For example, mask R-CNN may be based on fast R-CNN which is slightly different than R-CNN. For example, R-CNN first applies a convolutional neural network ("CNN") and then allocates it to zone recommendations on the covn5 property map instead of the initially split into zone recommendations. In addition, according to exemplary embodiments, standard CNN may be used to obtain, identify, or detect any other qualitative or quantitative data related to one or more objects or regions within the one or more images. In addition, a K-means algorithm may be used.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with new images, may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models. According to exemplary embodiments, it should be appreciated that the machine learning models may include supervised and/or unsupervised models and methods. In this regard, for example, supervised machine learning methods (e.g., such as targeted machine learning) may help identify problems, anomalies, or other occurrences which have been identified and trained into the model. By contrast, unsupervised machine learning methods may be used to detect clusters of potential failures, similarities among data, event patterns, abnormal concentrations of a phenomenon, etc.

It should be appreciated that image processing and machine learning image recognition processes may be used together to facilitate improved image analysis, object detection, e.g., detection of objects including an unapproved classification as described in more detail below, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

Figure 4:
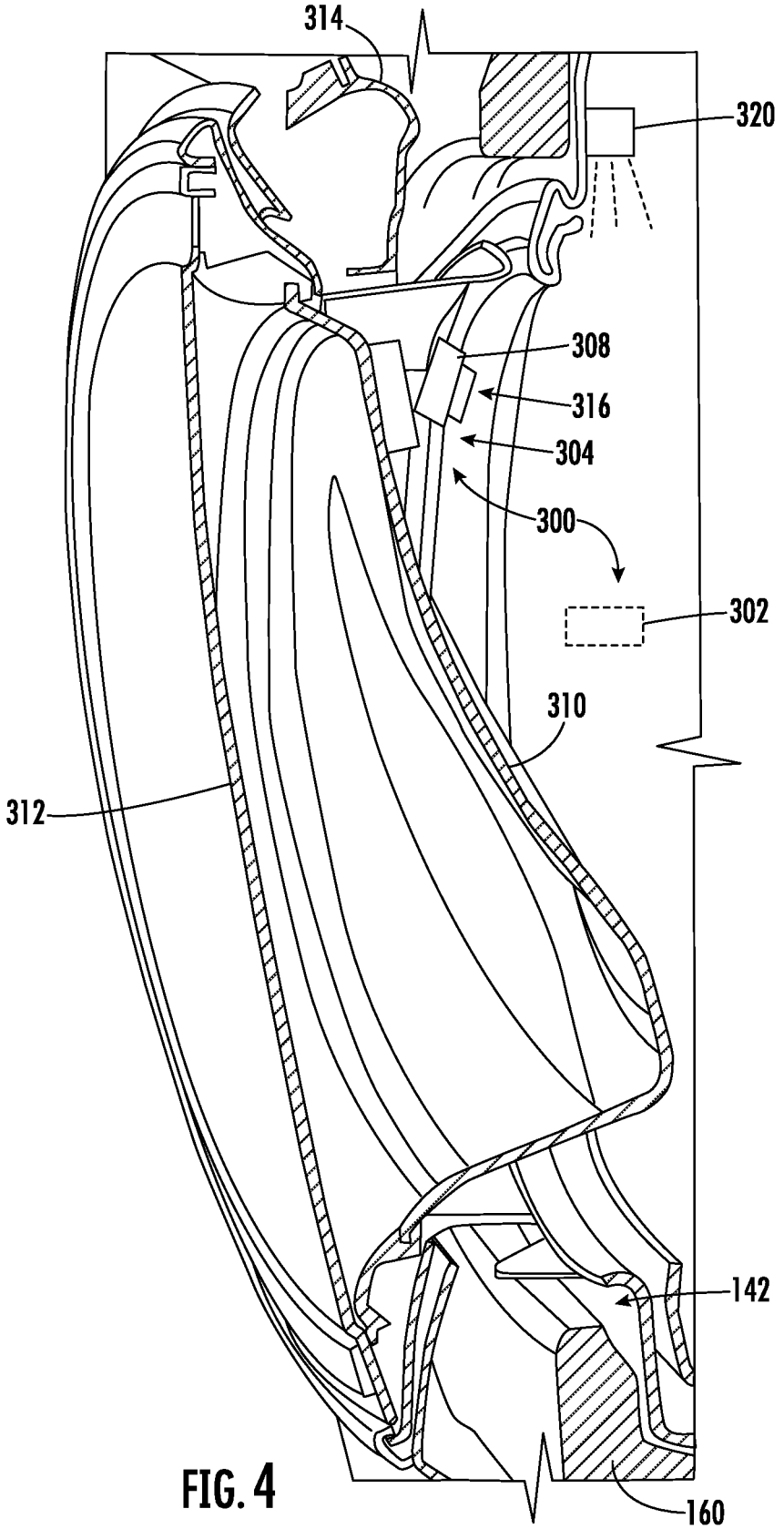
FIG. 4 provides a cross-sectional view of the exemplary washing machine appliance of FIG. 2 with a camera assembly mounted on a door according to an exemplary embodiment of the present subject matter.
Figure 5:
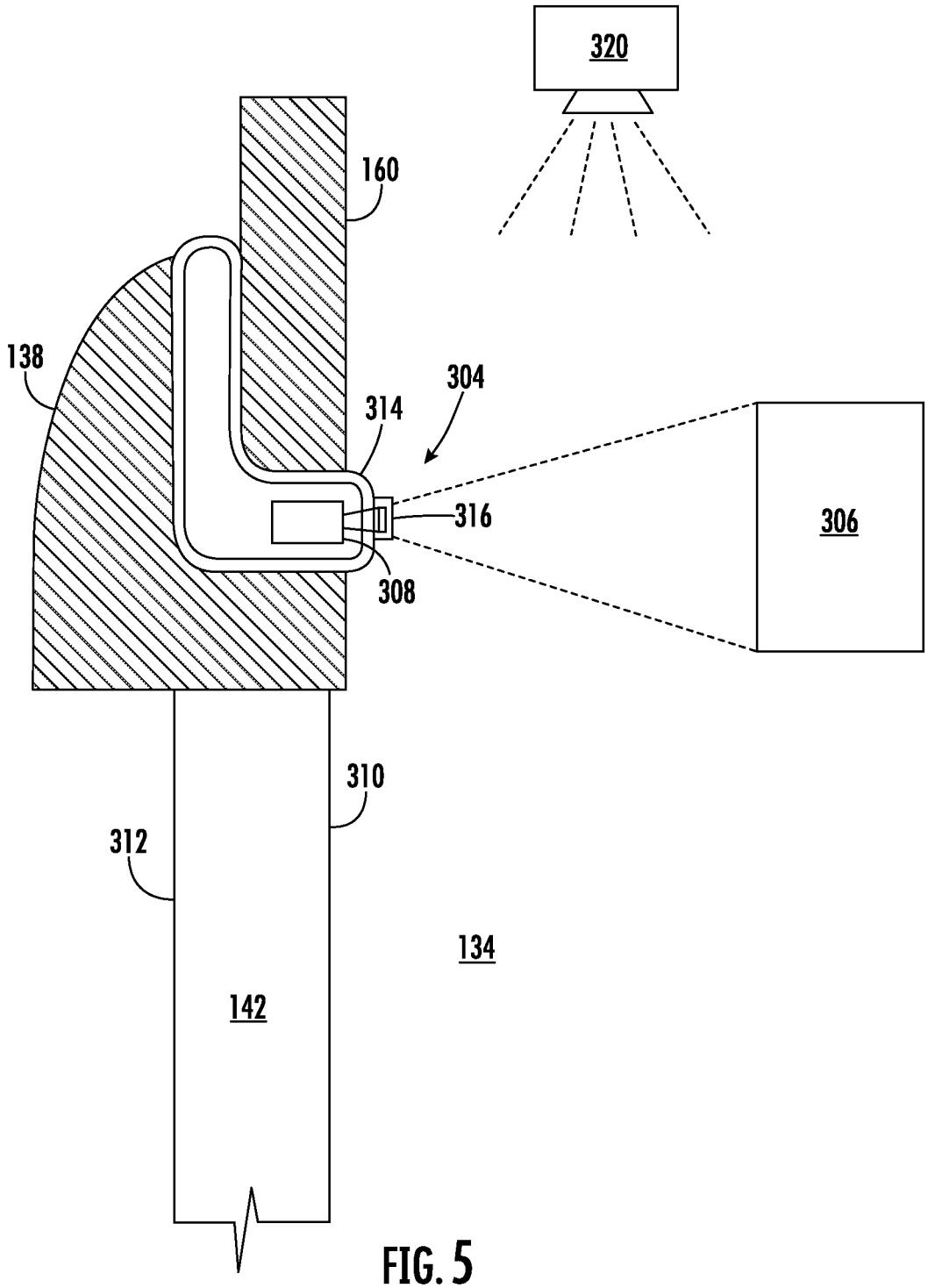
FIG. 5 provides a schematic view of a door and gasket sealed against a cabinet of the exemplary washing machine of FIG. 2, along with a camera mounted within the gasket according to an exemplary embodiment of the present subject matter.

Referring now briefly to FIG. 5, another installation of camera assembly 304 will be described according to an exemplary embodiment of the present subject matter. Due to the similarity between this and other embodiments, like reference numerals may be used to refer to the same or similar features. According to this exemplary embodiment, camera assembly 304 includes an internal camera 308 mounted within a gasket 314 that is positioned between a front panel 160 of cabinet 114 and door 138. In some embodiments, e.g., as illustrated in FIG. 5, cameras 308 may include a lens 316 that is constructed from a clear hydrophobic material, or which may otherwise be positioned behind a hydrophobic clear lens. So positioned, camera assembly 304 may obtain one or more images or videos of clothes 306, or other objects, for instance, objects including unapproved classifications, within wash chamber 134, as described in more detail below. Referring generally to FIGS. 2, 4, and 5, washing machine appliance 102 may further include a tub light 320 that is positioned within cabinet 114 or wash chamber 134 for selectively illuminating wash chamber 134 and any contents positioned therein. In additional embodiments, the laundry appliance 100 may include various internal lights, such as a drum light positioned and configured to illuminate the drum 202 of the dryer appliance. Although exemplary camera assemblies 304 are illustrated and described herein, it should be appreciated that according to alternative embodiments, laundry appliances 100 may include any other camera or system of imaging devices for obtaining images within and around the household appliance.

In embodiments, where camera assembly 304 includes a plurality of cameras, each of the plurality of cameras may have a specified monitoring zone or range positioned in the laundry appliance 100, such as multiple cameras oriented in or facing various directions within the laundry appliance 100. In this regard, for example, the field of view of each camera may be limited to or focused on a specific area. It should be appreciated that according to alternative embodiments, camera assembly 304 may include any suitable number, type, size, and configuration of camera(s) for obtaining images of any suitable areas or regions within or around household appliance 10. In addition, it should be appreciated that each camera may include features for adjusting the field of view or orientation.

It should be appreciated that the images obtained by camera assembly 190 may vary in number, frequency, angle, resolution, detail, etc. in order to improve the clarity of the particular regions within the laundry appliance 100. In addition, according to exemplary embodiments, controller 112 may be configured for selectively illuminating the interior of the laundry appliance 100 prior to obtaining images. Notably, controller 112 of the laundry appliance 100 (or any other suitable dedicated controller) may be communicatively coupled to camera assembly 304 and may be programmed or configured for analyzing or processing the images obtained by camera assembly 304.

In general, controller 112 may be operably coupled to camera assembly 304 for analyzing, manipulating, synthesizing or otherwise processing one or more images obtained by camera assembly 304 to extract useful information regarding objects within the field of view of the one or more cameras. Notably, such processing may be performed locally (e.g., on controller 112) or the images may be transmitted to a remote server (e.g., in the "cloud," as those of ordinary skill in the art will recognize as referring to a remote server or database in a distributed computing environment including at least one remote computing device) for analysis, processing, etc.

Figure 6:
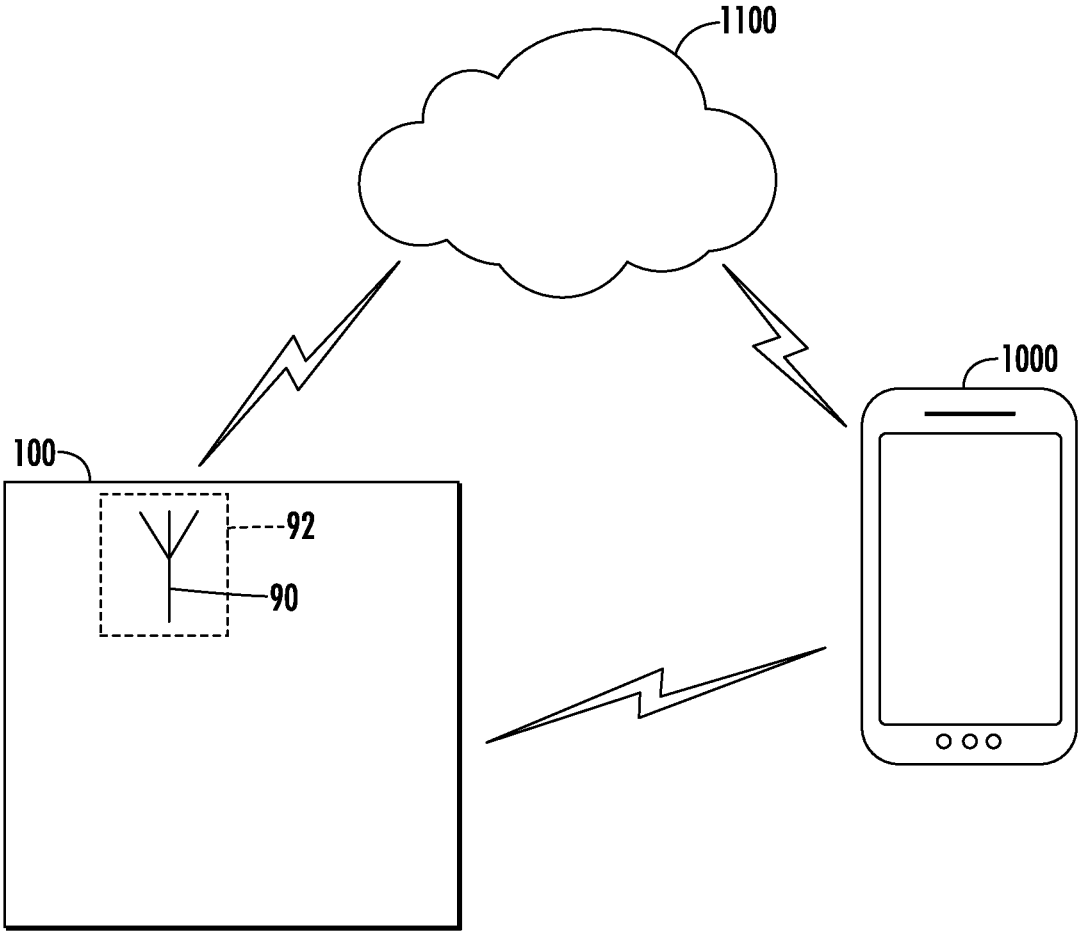
FIG. 6 provides a diagrammatic illustration of a household appliance in communication with a remote computing device and with a remote user interface device according to one or more exemplary embodiments of the present subject matter.

Turning now to FIG. 6, a general schematic is provided of a laundry appliance 100 (such as washing machine appliance 102 or dryer appliance 104), which communicates wirelessly with a remote user interface device 1000 and a network 1100. For example, as illustrated in FIG. 6, the laundry appliance 100 may include an antenna 90 by which the laundry appliance 100 communicates with, e.g., sends and receives signals to and from, the remote user interface device 1000 or network 1100. The antenna 90 may be part of, e.g., onboard, a communications module 92. The communications module 92 may be a wireless communications module operable to connect wirelessly, e.g., over the air, to one or more other devices via any suitable wireless communication protocol. For example, the communications module 92 may be a short rang wireless communication protocol such as a WI-FI® module, a BLUETOOTH® module, or a combination module providing both WI-FI® and BLUETOOTH® connectivity. The remote user interface device 1000 may be a laptop computer, smartphone, tablet, personal computer, wearable device, smart speaker, smart home system, or various other suitable devices. The communications module 92 may be onboard the controller 112 or may be a separate module.

The laundry appliance 100 may be in communication with the remote user interface device 1000 device through various possible communication connections and interfaces. The laundry appliance 100 and the remote user interface device 1000 may be matched in wireless communication, e.g., connected to the same wireless network. The laundry appliance 100 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the laundry appliance 100 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not physically connected to the laundry appliance 100, e.g., the remote user interface device 1000 is a separate, stand-alone device from the laundry appliance 100 which communicates with the laundry appliance 100 wirelessly. Any suitable device separate from the laundry appliance 100 that is configured to provide or receive communications, information, data, or commands from a user may serve as the remote user interface device 1000, such as a smartphone (e.g., as illustrated in FIG. 6), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface panel 106. For example, the remote user interface device 1000 may be a smartphone operable to store and run applications, also known as "apps," and the additional user interface may be provided as a smartphone app.

As mentioned above, the laundry appliance 100 may also be configured to communicate wirelessly with a network 1100. The network 1100 may be, e.g., a cloud-based data storage system including one or more remote computing devices such as remote databases or remote servers, which may be collectively referred to as "the cloud." For example, the laundry appliance 100 may communicate with the cloud 1100 over the Internet, which the laundry appliance 100 may access via WI-FI®, such as from a WI-FI® access point in a user's home.

Exemplary methods for operating a household appliance, such as a laundry appliance or cooking appliance as described above, are provided. In this regard, for example, a controller of the household appliance, e.g., controller 112, may be configured for implementing some or all steps of one or more of the following exemplary methods. However, it should be appreciated that the exemplary methods are discussed herein only to describe exemplary aspects of the present subject matter and are not intended to be limiting. Now that the construction of a laundry appliance 100 and the configuration of controller 112 according to exemplary embodiments have been presented, exemplary methods of operating a household appliance will be described. In exemplary embodiments, the various method steps as disclosed herein may be performed by controller 112 or a separate, dedicated controller. Furthermore, some or all of the various method steps may be performed remotely, e.g., in a distributed computing environment such as the cloud, fog, or edge, wherein the controller 112 communicates with one or more remote computing devices of the distributed computing environment, such as processing, e.g., image analysis or process, may be performed in the cloud and the output of such process may be transmitted to and received by the laundry appliance 100, such as by the controller 112 thereof via the communications module 92.

Figure 7:
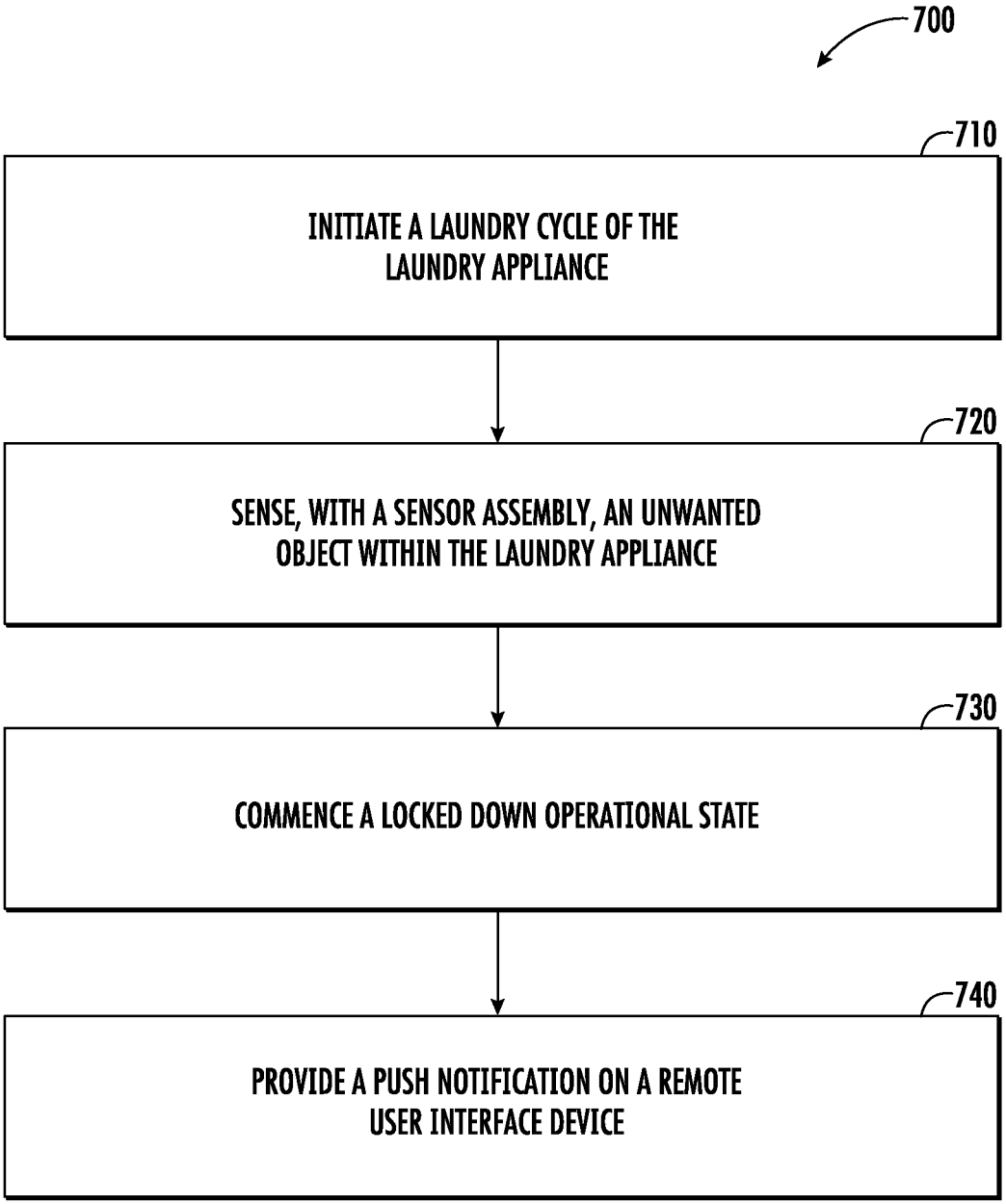
FIG. 7 provides a flow diagram of an exemplary method for detecting an object within a laundry appliance according to one or more exemplary embodiments of the present subject matter.

Referring now to FIG. 7, a flow diagram of a method 700 of operating a laundry appliance according to one or more exemplary embodiments of the present subject matter is provided. The method 700 of FIG. 7 may be utilized to detect objects within the one or more of the exemplary laundry appliances 100 (e.g., the washing machine appliance 102 or the dryer appliance 104) described above with reference to FIGS. 1 through 6. Particularly, the method 700 of FIG. 7 may be utilized to detect objects with an unapproved classification (e.g., objects that may have been mistakenly or accidentally placed within the drum or the basket of the laundry appliance). Accordingly, it will be appreciated that the method 700 may generally be utilized to detect objects within a laundry appliance including a cabinet, a drum or a basket, and a sensor assembly attached to or proximate to the drum or a basket. However, in other exemplary aspects, the method 700 may additionally or alternatively be utilized to detect objects within any other suitable laundry appliance (e.g., any suitable washing machine appliance or any suitable dryer appliance).

As is depicted, the method 700 includes, at 710, initiating a laundry cycle (e.g., a wash cycle of the washing machine appliance 102 or a dry cycle of dryer appliance 104) of the laundry appliance (e.g., laundry appliance 100). The method 700, at 710, of initiating the laundry cycle may include receiving an input indicative of the initiation of a laundry cycle. For example, the input received may be in response to a user's manipulation of an input selector (e.g., the input selector 108) of the laundry appliance. Initiating the laundry cycle may also include commencing a detection sequence of the laundry cycle. The detection sequence may generally detect an unwanted object that is positioned within the drum or the basket of the laundry appliance. The detection sequence may be executed prior to the start of the laundry cycle. The start of a laundry cycle may generally refer to an initial mechanical operation of the laundry appliance that may be utilized to launder articles held within the laundry appliance. For example, the start of the laundry appliance may include, but is not limited to, starting a countdown or a delay timer (e.g., to delay the start of the laundry appliance such as when a delay start capability of the laundry appliance is selected), a rotation of the drum or basket of the laundry appliance, the delivering of heat into a drum (e.g., via a heater assembly of a dryer appliance), the delivering of water or wash fluid into a basket of the laundry appliance (e.g., via dispensing assembly of a washing machine appliance).

The method 700 includes, at 720, evaluating, with a sensor assembly (e.g., sensor assembly 300), a classification of an object within an interior (e.g., a drum or a basket) of the laundry appliance. In certain embodiments, 720 follows or is in response to 710. In some embodiments, the sensor assembly includes a short-range wireless receiver (e.g., short-range wireless receiver 302) attached to laundry appliance, for instance, attached to a drum or a basket of the laundry appliance. In such embodiments, evaluating the classification of the object within the interior of the laundry appliance includes receiving, via the short-range wireless receiver, one or more short-range wireless signals from the object positioned within the laundry appliance. The wireless signal received from the object may be any suitable short-range wireless signal that may be transmitted from the object positioned within the laundry appliance. For example, the wireless signal may be a Bluetooth signal transmitted from a Bluetooth module onboard the object. As another example, the wireless signal may be an RFID signal transmitted from a RFID module onboard the object.

In such embodiments, the short-range wireless signal transmitted from the object may include information indicative of a classification of the object. The classification of the object may include an approved classification (e.g., approved for a laundry cycle) or an unapproved classification (e.g., unapproved for a laundry cycle). Information indicative of the approved classification of the object may be transmitted by objects that include embedded wireless transmitters and that are intended to be laundered. For example, articles (e.g., clothing articles or sheets) placed within the laundry appliance that include embedded wireless transmitters (e.g., embedded RFID sensors) may transmit information indicative of the approved classification. Information indicative of the unapproved classification may be transmitted by objects that include embedded wireless transmitters and that are not intended to be laundered. For example, electronic objects that include short range wireless transmitters (e.g., external devices such as the remote user interface device 1000) may transmit information indicative of the unapproved classification.

In some embodiments, a list of objects that may transmit information indicative of an approved classification or of an unapproved classification may be preloaded onboard a memory of the controller (e.g., controller 112) of the laundry appliance. In some other embodiments, a user may provide a list of objects that may transmit information indicative of an approved classification or of an unapproved classification. For example, a user may select or input a list of objects that may transmit information indicative of an approved classification or of an unapproved classification. For example, a user may select or input the list of objects on an app installed on a remote user interface device or via the display of the user interface. In yet some other embodiments, the list of objects that may transmit information indicative of an approved classification or an unapproved classification may be provided (e.g., periodically) via a network (e.g., network 1100) in operative communication with the controller of the laundry appliance.

In some other embodiments, the sensor assembly includes a camera assembly (e.g., camera assembly 304). The camera assembly may be operably coupled to a controller of the laundry appliance (e.g., controller 112) for analyzing, manipulating, synthesizing or otherwise processing one or more images obtained by the camera assembly to extract useful information regarding objects within the field of view of one or more cameras of the camera assembly (e.g., as described above). For instance, the interior of the laundry appliance (e.g., the drum of a dryer appliance or a basket of the washing machine appliance) may be positioned within the field of view of the one or more cameras.

In such embodiments, evaluating the classification of an object within the interior of the laundry appliance may include capturing images of the interior of the laundry appliance within one or more cameras of the camera assembly. In addition, evaluating the classification of an object within the interior of the laundry appliance may include performing image analysis (e.g., as described above) on the captured images. Further, evaluating the classification of an object within the interior of the laundry appliance may include detecting, based on the image analysis performed, that the object includes an unapproved classification. For instance, based on the image analysis, the object with the unapproved classification may be discerned from the images captured.

In such embodiments, evaluating the classification of an object within the interior of the laundry appliance include detecting, via the camera assembly, objects with an unapproved classification within the interior of the laundry appliance. For instance, the camera assembly may use any suitable image processing technique, image recognition process, etc., described in more detail above to sense objects with the unapproved classification within the interior of the laundry appliance. For instance, evaluating, with a camera assembly, the classification of the object within the interior of the laundry appliance may include detecting, via one or more image processing techniques described in more detail above, the presence of the object with the unapproved classification in the interior of the laundry appliance.

If one or more wireless signals received do not include information indicative of an unapproved classification transmitted from an object or if the camera assembly does not detect an object within the laundry appliance with an unapproved classification, the method 700 may include starting the laundry cycle in response to a failure to detect an object with an unapproved classification. In this regard, the laundry cycle that was selected, at 710, may be run and completed.

If the one or more wireless signals received does include information indicative of an unapproved classification transmitted from an object, the method 700 includes, at 730, commencing a locked down operational state in response to receiving a signal from the object with the unapproved classification positioned within the laundry appliance. In some embodiments, at 730, commencing the locked down operational state may includes adjusting the laundry cycle according to 720. For example, commencing the laundry appliance may be based on the classification of the object within the interior of the laundry appliance.

The locked down operational state may include a state or a mode of the laundry appliance wherein a laundry cycle may be adjusted or suspended. In some embodiments, in the locked down operational state of the laundry appliance operational parameters, of the laundry appliance may be adjusted. For instance, operational parameters of the laundry appliance may be adjusted based on the classification of the object. For example, in the locked down operational state, a dryer temperature of a dryer appliance may be lowered. As another example, in the locked down operational state, an agitation speed of washing machine appliance may be lowered. In some other embodiments, in the locked down operational state of the laundry appliance, one or more inputs positioned on the control panel of the laundry appliance may be locked. For example, in the locked down operational state of the laundry appliance, a start input on the control panel may be locked. In this regard, a user may not be capable of starting the laundry appliance, for instance, when the object with the unapproved classification is positioned within the laundry appliance.

Additionally or alternatively, in some instances, the object with the unapproved classification may not be sensed until after a laundry cycle has already been started. In such instances, the locked down operational state may suspend or pause the laundry cycle. For example, if the laundry appliance is a washing machine appliance, starting the laundry cycle may include flowing a fill of liquid water into a basket of the washing machine. In such instance, suspending or pausing the laundry cycle may include draining the fill of liquid water or wash fluid from the basket. As another example, if the laundry appliance is a dryer appliance, starting the laundry cycle may include delivering a flow of heated air from a heater assembly into a drum of the dryer appliance. In such instances, suspending or pausing the laundry cycle may include suspending the delivery of heated air in response to the evaluating the classification of an object within the interior of the laundry appliance.

The method 700 includes, at 740, providing a push notification on a remote user interface device, such as the remote user interface device 1000, based on commencing the locked down operational state. The push notification may be configured to alert or notify a user that the object including the unapproved classification has been sensed or detected within the interior of the laundry appliance. In some instances, the push notification may notify the user that the laundry cycle may not be started until the object including the unapproved classification is removed from the interior of the laundry appliance.

Additionally or alternatively, the push notification may include an override prompt. The override prompt may give the user an option to start the laundry cycle despite the object including the unapproved classification being sensed within the laundry appliance. If an affirmative action is transmitted in response to the override prompt (e.g., if a user decides to accept the override prompt) the laundry cycle may be started or resumed.

Further additionally or alternatively, the method 700 may include providing an alert on a display of the laundry appliance in response to commencing the locked down operational state. For instance, the alert may be provided as text on the display of the user interface of the laundry appliance, such as on display 110. The text may indicate or notify a user of the laundry appliance that an object including an unwanted classification has been sensed within the laundry appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry appliance, the method comprising:

initiating a laundry cycle of the laundry appliance;

evaluating, with a sensor assembly, a classification of an object within an interior of the laundry appliance;

commencing a locked down operational state in response to evaluating the classification of the object within the interior of the laundry appliance; and providing a push notification on a remote user interface device based on commencing the locked down operational sate, the push notification comprising information indicative of the object, wherein providing the push notification on the remote user interface device comprises providing an override prompt for overriding the locked down operational state on the remote user interface device.

2. The method of claim 1, wherein the sensor assembly includes a short-range wireless receiver, and wherein evaluating the classification of an object within the interior of the laundry appliance comprises receiving, via the short-range wireless receiver, a short-range wireless signal from the object within the interior of the laundry appliance.

3. The method of claim 1, wherein the sensor assembly includes a camera assembly, wherein evaluating the classification of an object within the interior of the laundry appliance comprises capturing images of an interior of the laundry appliance with one or more cameras of the camera assembly, performing image analysis on the captured images, and detecting, based on the image analysis performed, the object within the interior of the laundry appliance.

4. The method of claim 1, wherein commencing the locked down operational state comprises locking a user interface panel of the laundry appliance, wherein locking the user interface panel comprises limiting capabilities of the user interface panel.

5. The method of claim 4, wherein commencing the locked down operational state comprises providing an alert on a display of the user interface panel in response to locking one or more inputs on the user interface panel.

6. The method of claim 1, further comprising:

starting the laundry cycle of the laundry appliance in response to an affirmative action to the override prompt.

7. The method of claim 6, wherein starting the laundry cycle of the laundry appliance comprises flowing a fill of water into a basket of the laundry appliance.

8. The method of claim 6, wherein starting the laundry cycle of the laundry appliance comprises delivering a flow of heated air into a drum of the laundry appliance from a heater assembly.

9. A laundry appliance comprising:

a cabinet defining an interior for receiving articles for laundering;

a sensor assembly attached to the cabinet; and a controller configured for:

initiating a laundry cycle of the laundry appliance;

evaluating, with the sensor assembly, a classification of an object within an interior of the laundry appliance;

commencing a locked down operational state in response to evaluating the classification of the object within the interior of the laundry appliance; and providing a push notification on a remote user interface device based on commencing the locked down operational sate, the push notification comprising information indicative of the object, wherein providing the push notification on the remote user interface device comprises providing an override prompt for overriding the locked down operational state on the remote user interface device.

10. The laundry appliance of claim 9, wherein the sensor assembly includes a short-range wireless receiver, and wherein evaluating the classification of an object within the interior of the laundry appliance comprises receiving, via the short-range wireless receiver, a short-range wireless signal from the object within the interior of the laundry appliance.

11. The laundry appliance of claim 9, wherein the sensor assembly includes a camera assembly, wherein evaluating the classification of an object within the interior of the laundry appliance comprises capturing images of an interior of the laundry appliance with one or more cameras of the camera assembly, performing image analysis on the captured images, and detecting, based on the image analysis performed, the object within the interior of the laundry appliance.

12. The laundry appliance of claim 9, wherein commencing the locked down operational state comprises locking a user interface panel of the laundry appliance, wherein locking the user interface panel comprises limiting capabilities of the user interface panel.

13. The laundry appliance of claim 12, wherein commencing the locked down operational state comprises providing an alert on a display of the user interface panel in response to locking one or more inputs on the user interface panel.

14. The laundry appliance of claim 9, wherein the controller is further operable for:

starting the laundry cycle of the laundry appliance in response to an affirmative action to the override prompt.

15. The laundry appliance of claim 14, wherein starting the laundry cycle of the laundry appliance comprises flowing a fill of water into a basket of the laundry appliance.

16. The laundry appliance of claim 14, wherein starting the laundry cycle of the laundry appliance comprises delivering a flow of heated air into a drum of the laundry appliance from a heater assembly.

* * * * *